US005766095A

United States Patent [19]

Antonious

[11] Patent Number: 5,766,095

[45] Date of Patent: Jun. 16, 1998

[54] METALWOOD GOLF CLUB WITH ELEVATED OUTER PERIPHERAL WEIGHT

[76] Inventor: Anthony J. Antonious, 7738 Calle Facil, Sarasota, Fla. 34238

[21] Appl. No.: 787,108

[22] Filed: Jan. 22, 1997

[51] Int. Cl.[6] ..... A63B 53/04

[52] U.S. Cl. ..... 473/345; 473/349

[58] Field of Search ..... 473/324, 327, 473/328, 345, 346, 349, 350, 282, 334, 341; D21/214, 215, 216, 217, 218, 219, 220

[56] References Cited

U.S. PATENT DOCUMENTS

| | | | |
|---|---|---|---|
| 2,254,528 | 9/1941 | Hoare | 473/350 |
| 4,211,416 | 7/1980 | Swanson | 473/349 |
| 5,335,914 | 8/1994 | Long | 473/350 |
| 5,447,307 | 9/1995 | Antonious | 473/350 |
| 5,482,279 | 1/1996 | Antonious | 473/327 |

*Primary Examiner*—Sebastiano Passaniti

*Attorney, Agent, or Firm*—Aquilino & Welsh

[57] ABSTRACT

A metalwood type golf club head having a raised or elevated outer perimeter mass extending from a surface on the hosel onto and outwardly from at least a part of the outer surface of the metal shell of the club head body.

20 Claims, 10 Drawing Sheets

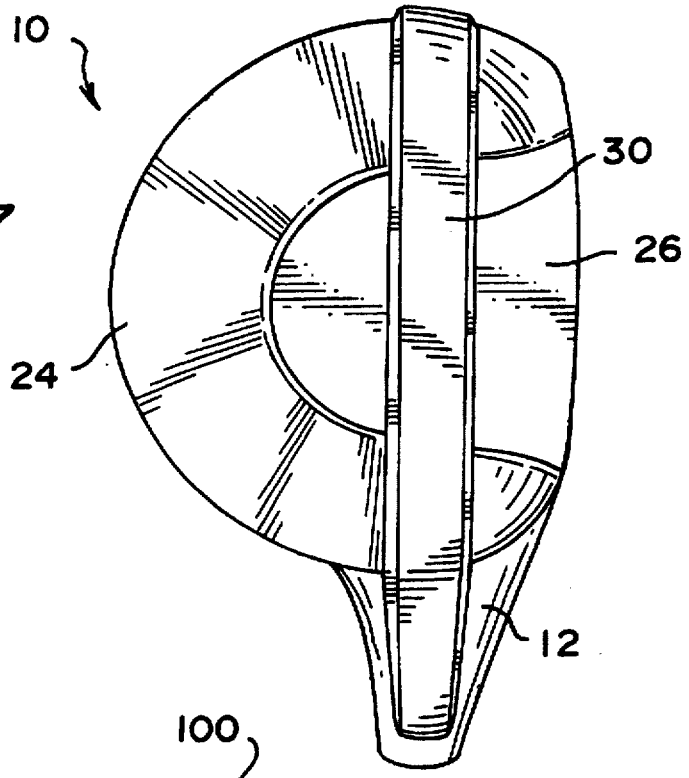
FIG. 7
FIG. 8
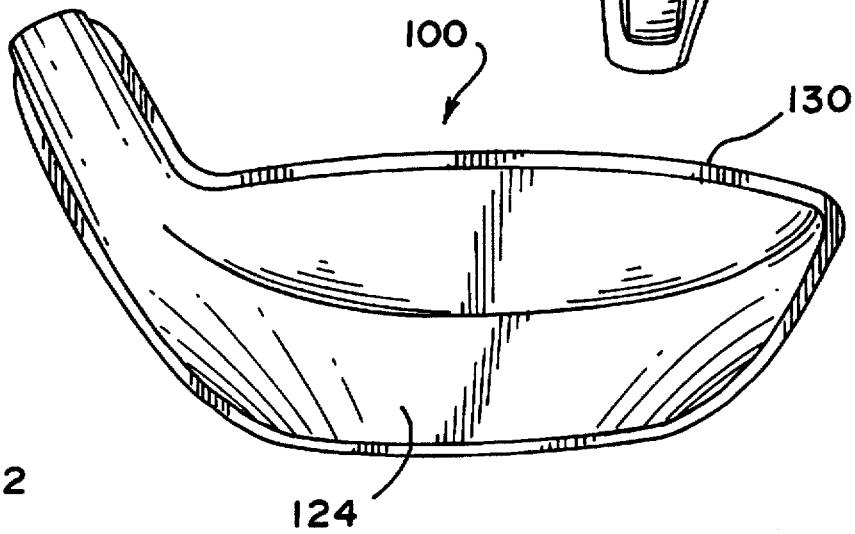
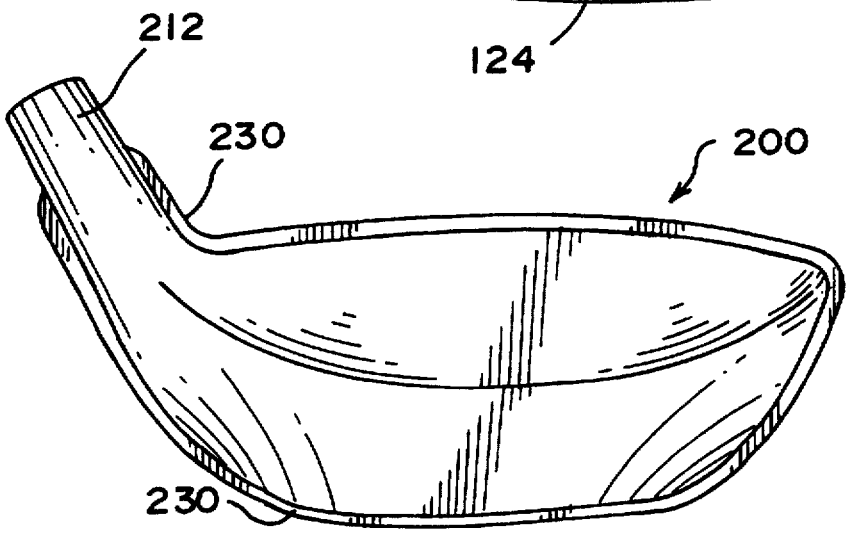
FIG. 9

FIG. 13
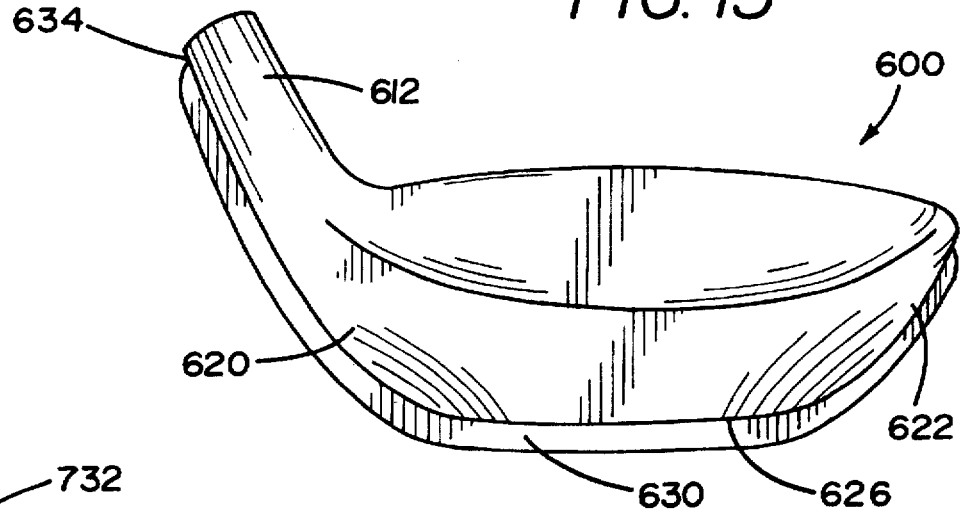
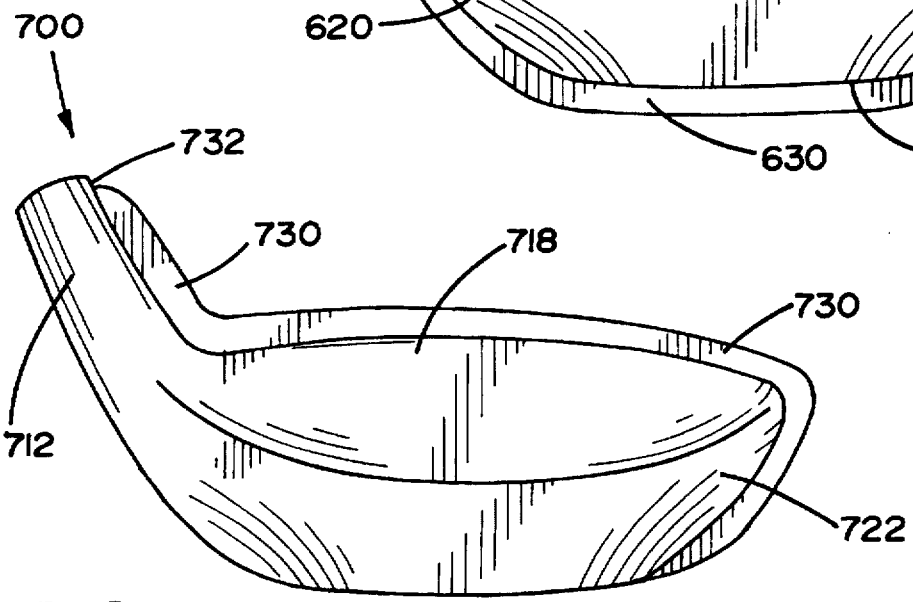
FIG. 14
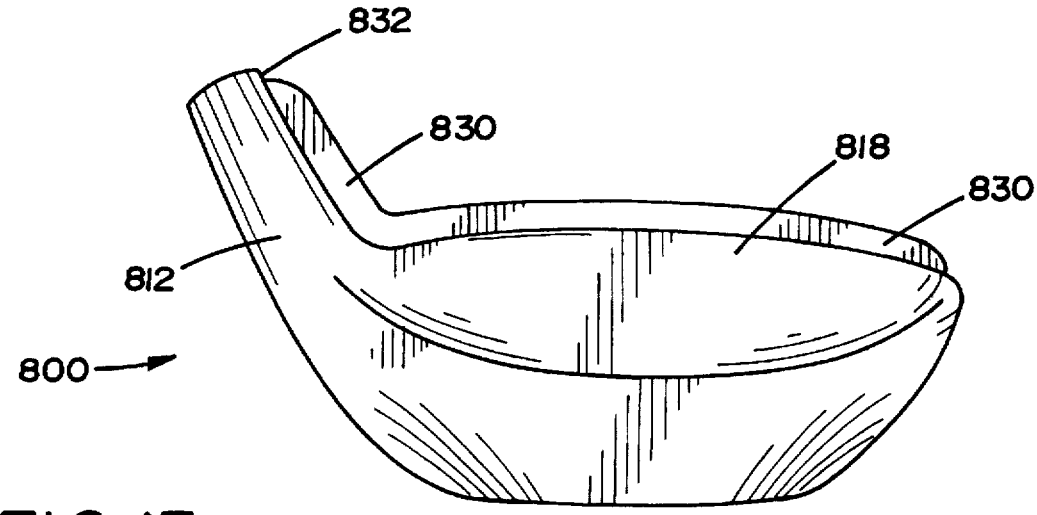
FIG. 15

FIG. 16
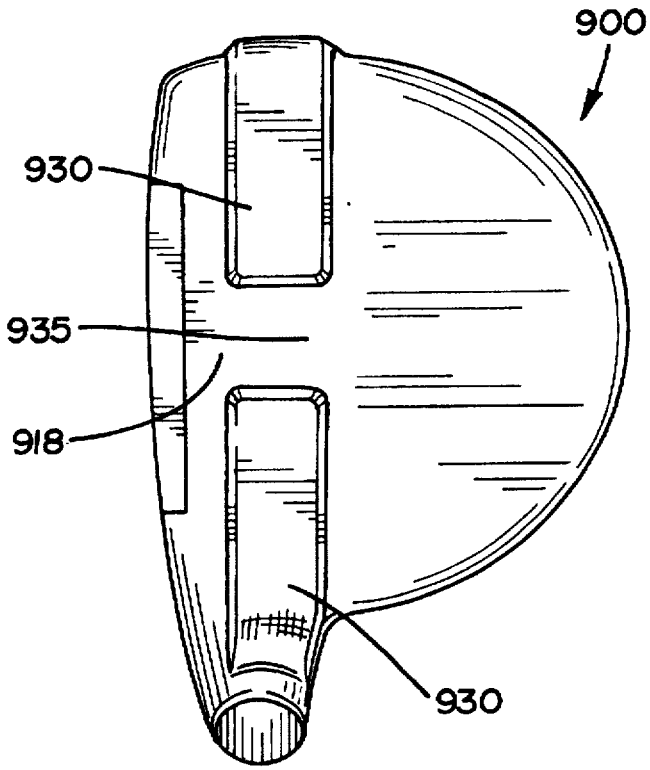
FIG. 17
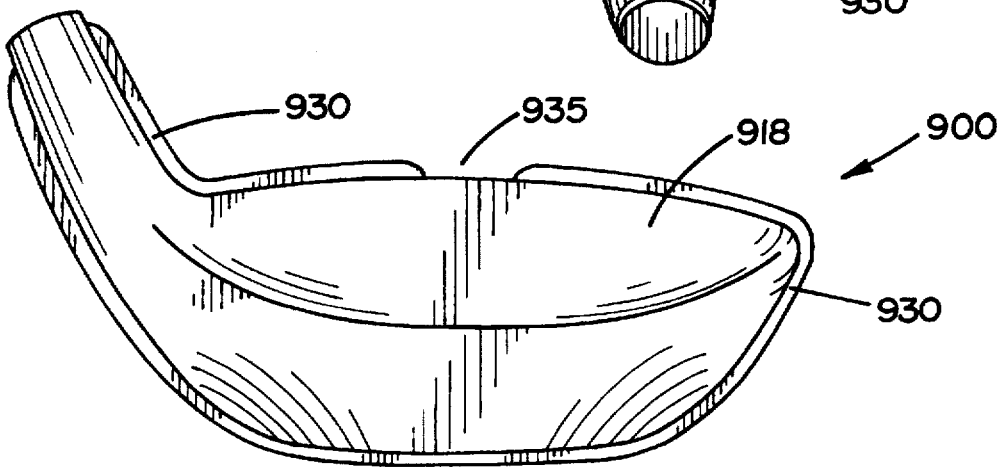
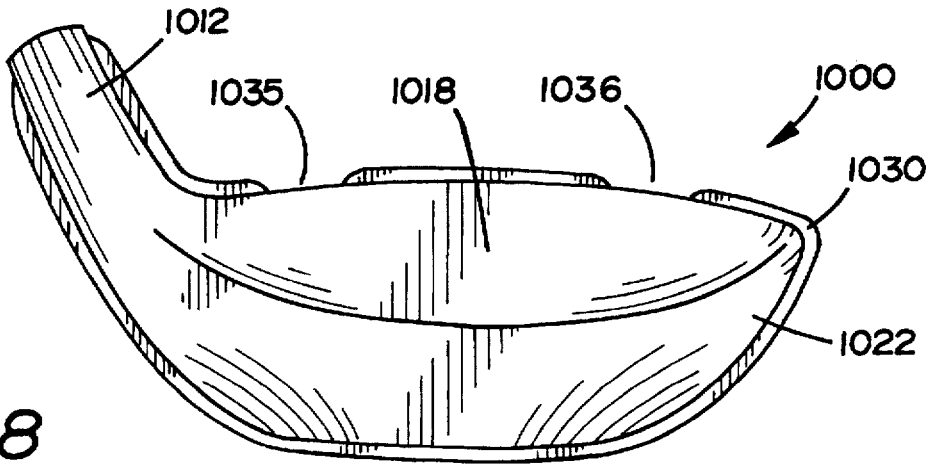
FIG. 18

FIG. 19
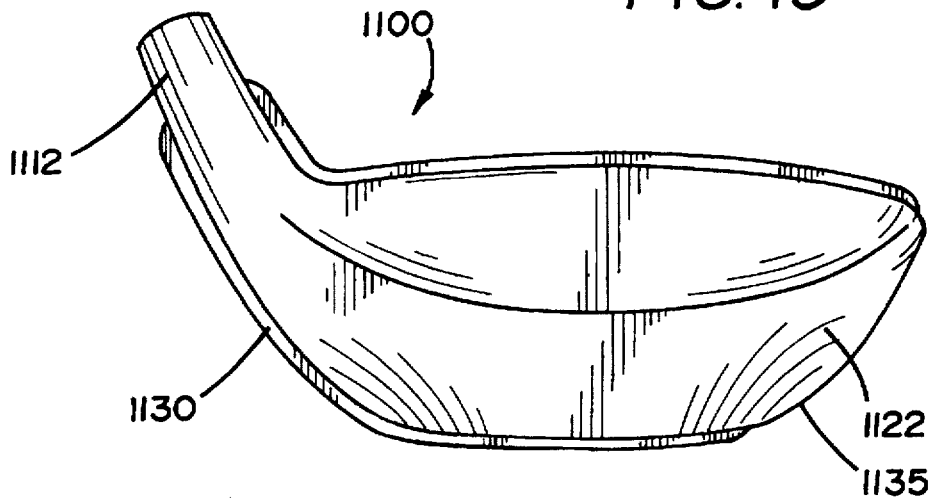
FIG. 20
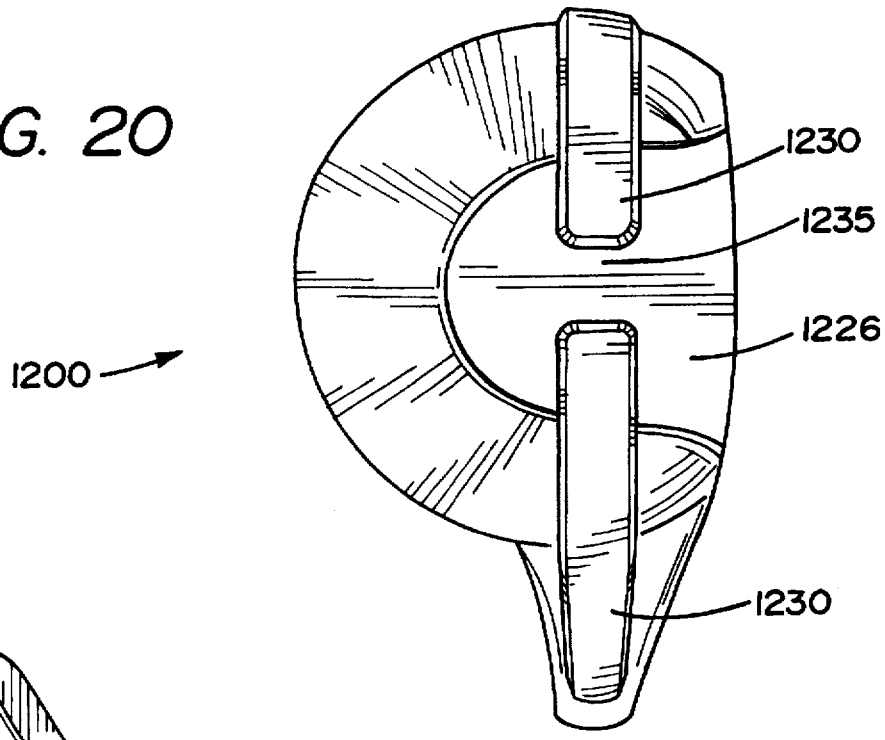
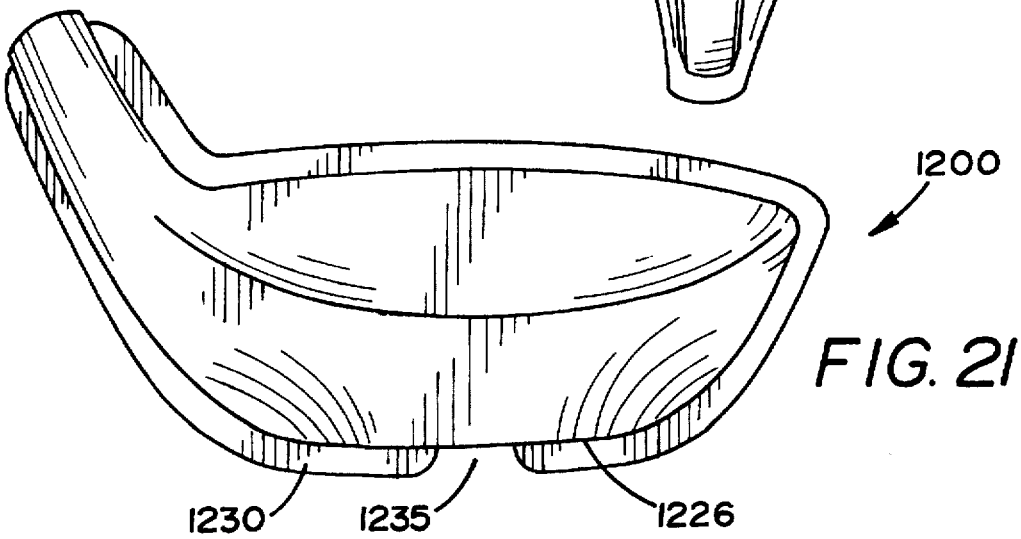
FIG. 21

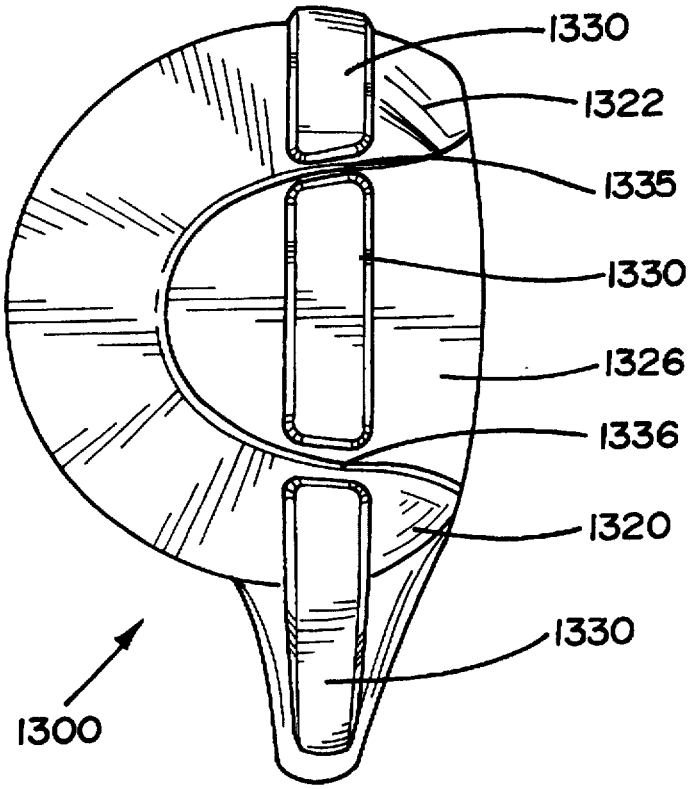
FIG. 22
FIG. 23
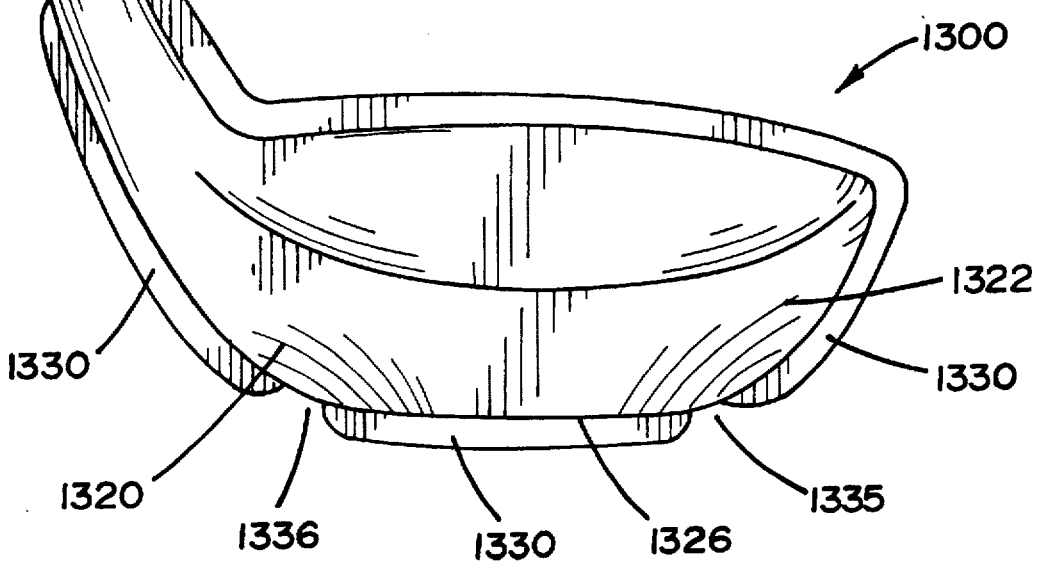

FIG. 24
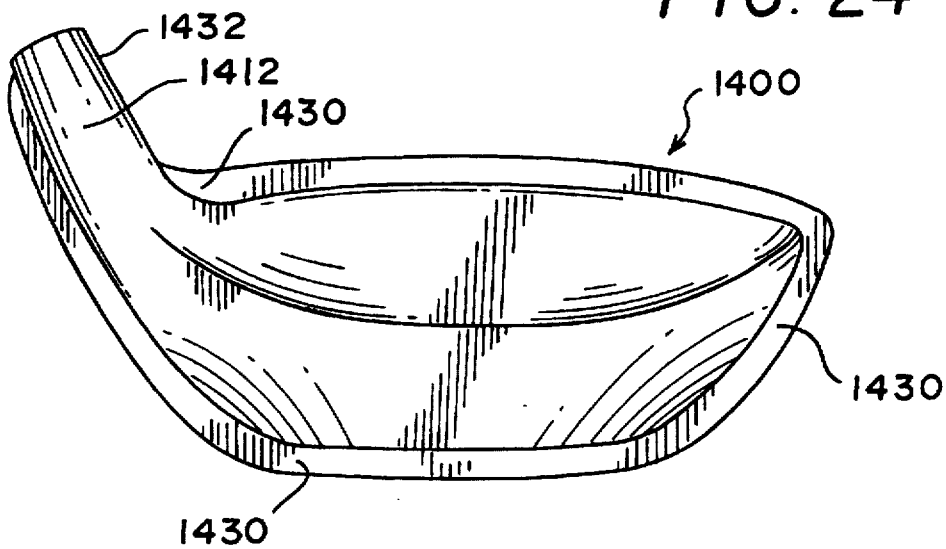
FIG. 25
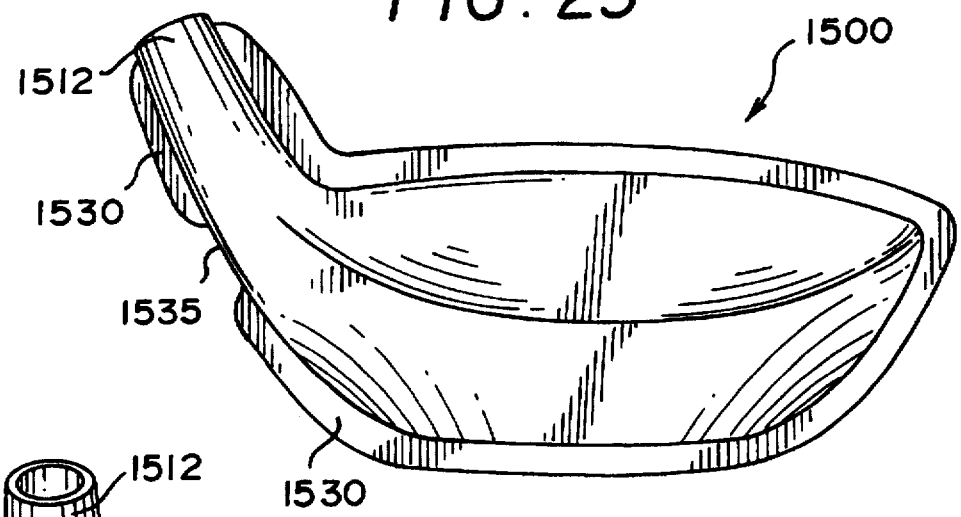
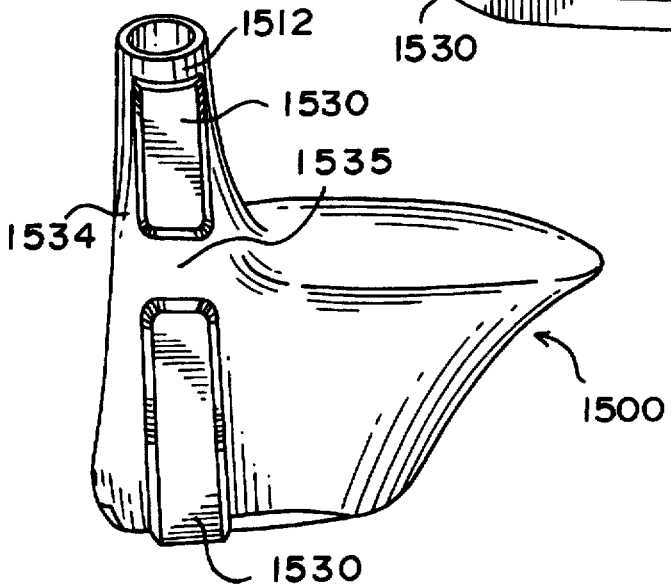
FIG. 26

METALWOOD GOLF CLUB WITH ELEVATED OUTER PERIPHERAL WEIGHT

BACKGROUND AND SUMMARY OF THE INVENTION

The present invention relates to metal wood type golf club heads and particularly to a metal wood type golf club head having an improved elevated or raised outer perimeter weight.

It has long been recognized that golf clubs with outer peripheral weighting systems are more forgiving and provide less twisting and torque when a golf ball is mis-hit off of the center of percussion. Various attempts have been made to adjust the mass of the club head by positioning metal weights on and within the club head body for the purposes described. Reference is made to U.S. Pat. Nos. 1,452,845 to Pryde, 1,473,528 to Tootle, 3,941,390 to Hussey, 4,732,389 to Kobayashi, and 5,076,585 to Bouquet and my own U.S. Pat. Nos. 5,511,786, 5,221,086, 5,193,810, 5,141,230 and 5,004,241, which show various weight configurations for wood type golf club heads.

The present invention is directed to a metal wood type golf club head having an elevated outer peripheral mass which extends beyond the metal shell of the club head body and connects with the hosel portion of the club head. This additional elevated outer perimeter of mass surrounds the club face to provide an extended unitized peripheral mass thereby enlarging the moment of inertia and decreasing the twisting and torque, making the club head more forgiving without enlarging the club face. By extending the raised peripheral mass up onto the hosel, greater club head control is provided resulting in increased club head stability at impact, especially for off-center hits. The inclusion of increased mass above the crown and frontally positioned on the club head produces more top spin, resulting in lower ball flight trajectory and increased distance. The set back location of the elevated outer peripheral mass is optimally positioned rearwardly from the club face and across the upper portion of the crown along the entire length of the club head in a heel to toe direction which results in repositioning the center of gravity rearwardly from the front ball striking face of the club head. The bottom portion of the raised outer perimeter mass formed on the sole of the club head acts as a raised runner in a heel to toe direction to minimize any adverse effects that may occur when ground contact is made. The raised portion of the outer perimeter mass across the upper crown substantially increases the rigidity and strength to eliminate or greatly reduce cave-ins and buckling of the metal shell forming the club head body. The raised outer perimeter mass also acts as a vibration and shock dampener eliminating undesirable audio effects as well as stress forces which are created by ball contact with the club head and which tend to travel up the shaft to the hands of the golfer creating the above effects. The raised outer perimeter mass across the crown also acts as an additional aligner to aid the golfer making visual a precision square alignment when the club head is addressed behind the ball to the target.

Various embodiments are contemplated by the present invention. In a preferred embodiment, the elevated outer perimeter mass extends from the top of a frontal portion of the hosel across the entire club head body including the upper surface, toe surface, bottom surface, heel surface and back to the underside of the hosel. Other embodiments include elevated outer peripheral masses which extend from the hosel only part way across the surface of the club head body.

Still other embodiments contemplate the use of gaps in the raised outer peripheral mass to more precisely position the raised outer peripheral mass on the club head body.

Among the objects of the present invention are the provision of a metal wood golf club having an elevated outer peripheral mass extending outwardly from the metal shell of the club head to increase stability and minimize torquing, twisting, buckling and knock-back, particularly when a golf ball is struck off of the center of percussion of the club head.

Another object of the present invention is the provision of an elevated outer peripheral mass which repositions the center of gravity to preselected positions on the club head rearwardly from the ball striking face.

Still another object of the present invention is the provision of an elevated outer peripheral mass which minimizes adverse effects when ground contact is made.

Still another object of the present invention is the provision of an elevated outer peripheral mass which increases the rigidity and strength of the club head.

Yet another object of the present invention is the provision of an elevated outer peripheral mass which aids in precise alignment of the club head when it is addressed prior to making a golf shot.

These and other objects of the present invention will become apparent from the following detailed description when viewed in conjunction with the accompanying drawings, which set forth certain embodiments of the invention.

BRIEF DESCRIPTION OF THE DRAWINGS

FIG. 7 is a bottom view.

FIG. 8 is a rear elevational view of a second embodiment of the present invention.

FIG. 9 is a rear elevational view of a third embodiment of the present invention.

FIG. 13 is a rear elevational view of a seventh embodiment of the present invention.

FIG. 14 is a rear elevational view of an eighth embodiment of the present invention.

FIG. 15 is a rear elevational view of a ninth embodiment of the present invention.

FIG. 16 is a top plan view of a tenth embodiment of the present invention.

FIG. 17 is a rear elevational view of the club head of FIG. 16.

FIG. 18 is a rear elevational view of an eleventh embodiment of the present invention.

FIG. 19 is a rear elevational view of a twelfth embodiment of the present invention.

FIG. 20 is a bottom view of a thirteenth embodiment of the present invention.

FIG. 21 is a rear elevational view of the club head of FIG. 20.

FIG. 22 is a bottom view of a fourteenth embodiment of the present invention.

FIG. 23 is a rear elevational view of the club head of FIG. 22.

FIG. 24 is a rear elevational view of a fifteenth embodiment of the present invention.

FIG. 25 is a rear elevational view of a sixteenth embodiment of the present invention.

FIG. 26 is a heel elevational view of the club head of FIG. 25.

DESCRIPTION OF THE PREFERRED EMBODIMENTS

Figure 1:
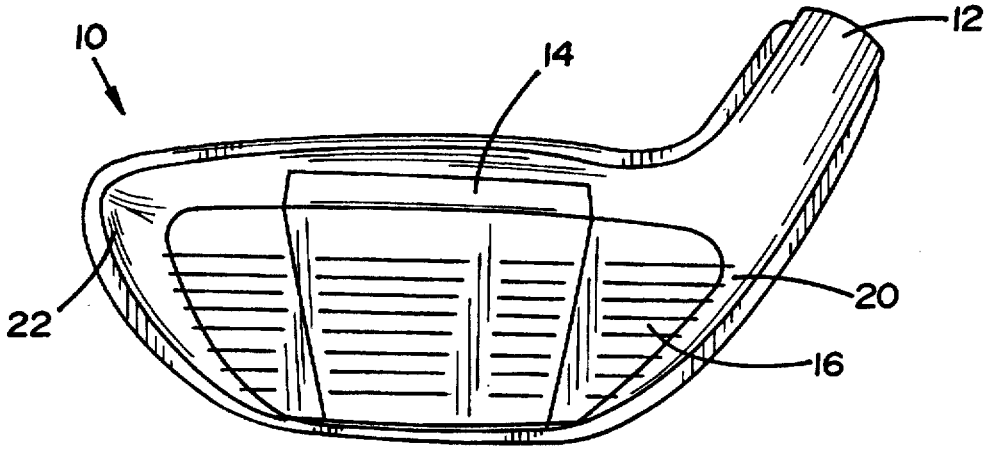
FIG. 1 is a front elevational view of a first embodiment of a golf club head in accordance with the present invention.
Figure 2:
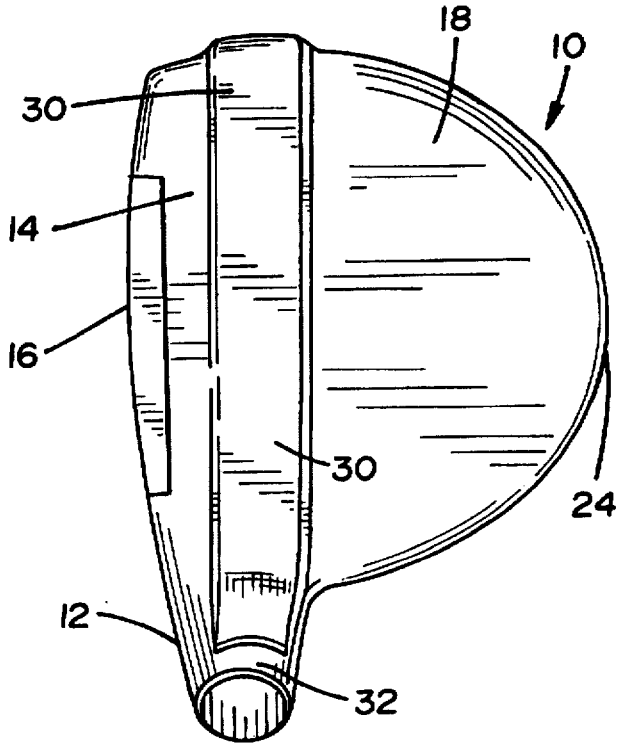
FIG. 2 is a top plan view of the club head of FIG. 1.
Figure 3:
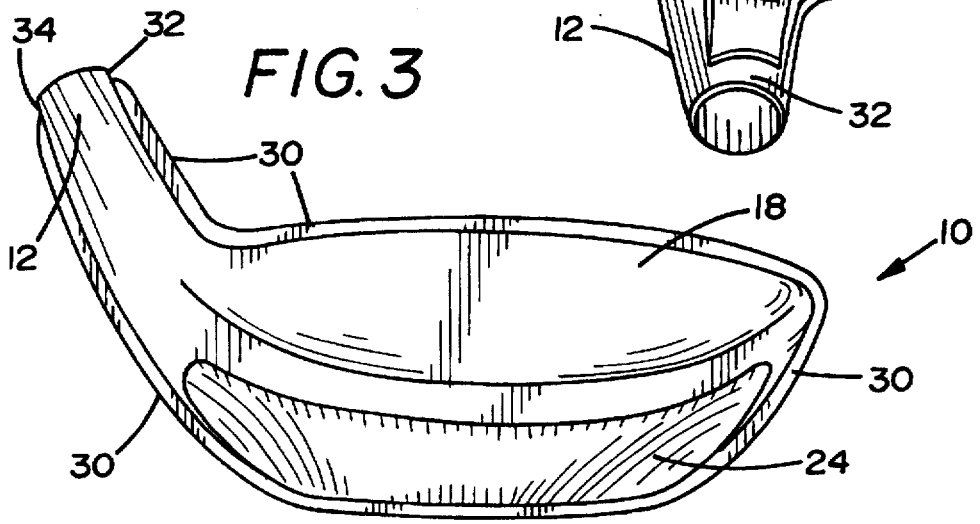
FIG. 3 is a rear elevational view.
Figure 4:
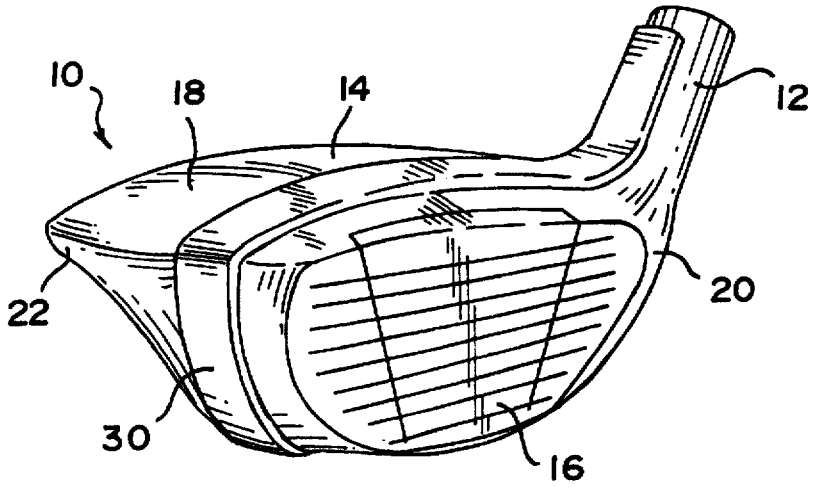
FIG. 4 is a front perspective view.
Figure 6:
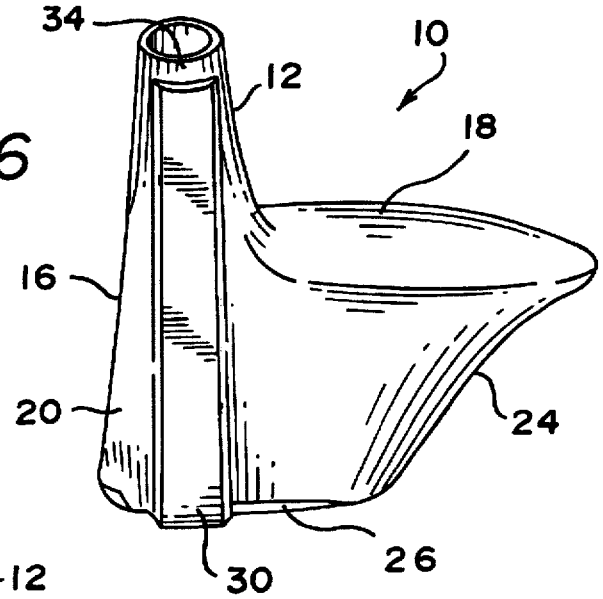
FIG. 6 is a heel end elevational view.
Figure 5:
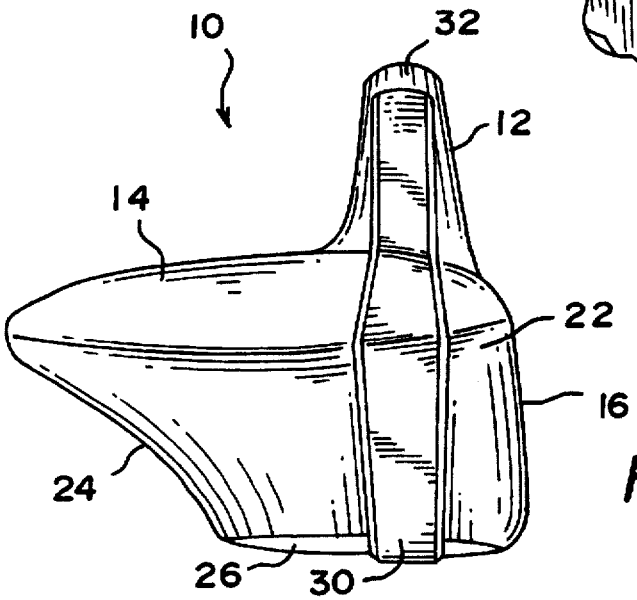
FIG. 5 is a toe end elevational view.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

FIGS. 1–7 show a first embodiment of a golf club head 10 in accordance with the present invention. The club head 10 includes a hosel 12 and a club head body 14 formed of a metal shell and having an outer surface including a ball striking face 16, top surface 18, heel surface 20, toe surface 22, rear surface 24 and bottom surface 26. It will be appreciated that the club head configuration is conventional in design. In this regard it will be noted that the rear surface 24, as well as portions of the heel surface 20 and toe surface 22 are aerodynamically shaped, as best can be seen from FIGS. 3–7, to increase club head speed and minimize turbulence. The present invention provides an elevated outer peripheral mass 30 which extends outwardly from the outer surface of the club head 10 forming a raised projection set back from the ball striking face 16 and lying in a generally heel surface to toe surface orientation. The elevated outer peripheral mass 30 begins from the hosel 12 and extends onto the outer surface of the club head body 14 creating an additional connection between the hosel and club head body. In this preferred embodiment, the raised or elevated outer peripheral mass 30 extends from a frontal surface 32 of the hosel downwardly onto the upper surface 18, the toe surface 22, bottom surface 26, heel surface 20 and upwardly to a rear surface 34 of the hosel 12. As can be seen from the drawings, the elevated outer peripheral mass 30 has a generally narrow rectangular cross-section which overlays the outer surfaces of the club head 10. The structure provides a solid, unitized connection between the hosel 12 and the club head body 14. By providing the mass 30 on the outer surfaces, the overall weight of the club head is extended to the outermost peripheral edges which increases club head stability when a golf ball is struck, especially for off-center hits. As can be seen from FIG. 2, the elevated outer peripheral mass 30 is set back behind the ball striking face 16 which relocates the center of gravity of the club head closer to the mass 30. The elevated outer peripheral mass 30 creates an outer reinforced frame-like member to increase the rigidity and strength of the shell of the club head body 14 by acting as a brace or support along the outer peripheral surfaces. Again referring to FIG. 2, the elevated outer peripheral mass 30 is generally parallel to the ball striking face 16, which of course, has a slight curvature or bulge, and provides a means to aid the golfer in aligning the club head to the intended target line by simply positioning the mass 30 perpendicular thereto.

Referring to FIG. 7, the bottom portion of the elevated outer peripheral mass 30 formed on the bottom surface 26 of the club head 10 acts as a raised runner in a heel to toe direction which minimizes adverse effects that may occur when ground contact is made, such as bounce, fat shots, divots and the like, which affect club head speed.

The golf club head with the elevated outer peripheral mass provides substantially more hitting area, or a larger so-called "sweet spot" on a standard club face by shifting the weight to the outside of the club head. This produces increased stability when ball contact occurs toward the rim or outermost portions of the club face because a larger moment of inertia results from the outer weight location. In turn, this results in the minimizing of the loss of distance and accuracy when ball contact is made off of the center of the club head. Since the elevated outer peripheral mass is connected between the hosel and the club head creating a unitized mass, overall club head control is enhanced. An analogy may be made to the structure of a tennis racquet, where the handle or grip smoothly transitions into the frame which supports the racquet strings. Overall, the club provides a more solid feel directly from the club head through the hosel and shaft directly to the golfer.

FIGS. 8–28 show additional embodiments with variations in the size, shape and placement of the raised outer peripheral mass on conventional type club heads. It will be appreciated that like parts of the club head in each of the embodiments are identical except where specifically otherwise indicated, and for the sake of brevity, only the structure of the outer peripheral mass will be described in detail.

Referring to FIG. 8, a golf club head 100 is shown with an elevated outer peripheral mass 130 extending around the entire perimeter of the club head. This embodiment differs from the first embodiment only in the shape of the rear and bottom surfaces 124 which do not have the aerodynamic configurations of the first embodiment shown in FIGS. 1–7.

FIG. 9 shows a third embodiment of a golf club head 200 wherein the elevated outer peripheral mass 230 begins part way down the length of the hosel 212, rather than adjacent the upper edge of the hosel, as with the first embodiment.

Figure 10:
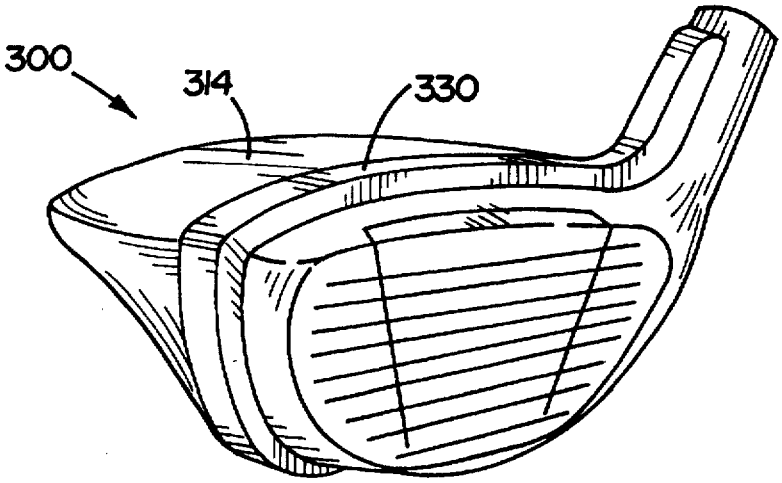
FIG. 10 is a front perspective view of a fourth embodiment of the present invention.

FIG. 10 shows a fourth embodiment of a club head 300 including an elevated outer peripheral mass 330 formed on an aerodynamic club head body 314. The outer peripheral mass 330 is narrower and higher, being more square in cross-section than the mass shown in the previous figures.

Figure 11:
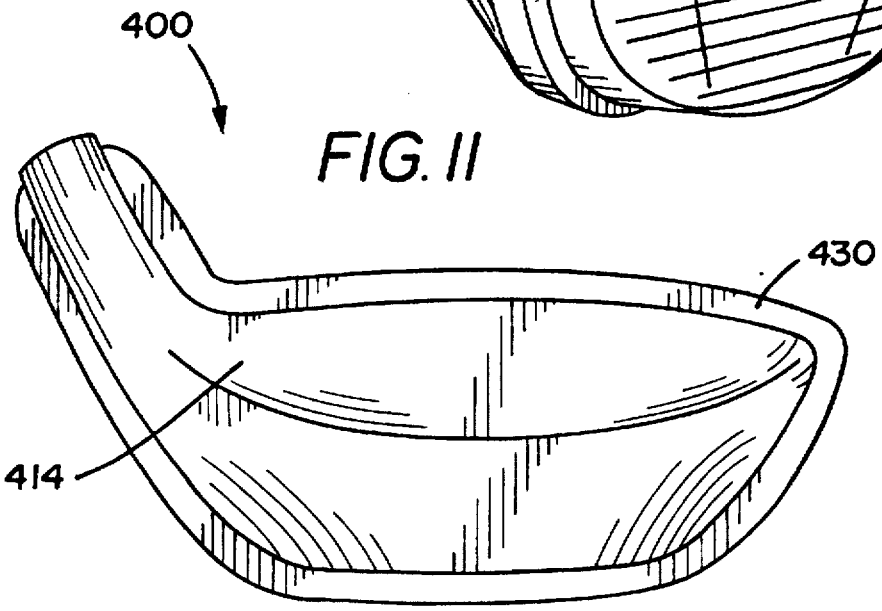
FIG. 11 is a rear elevational view of a fifth embodiment of the present invention.

FIG. 11 shows a fifth embodiment of a club head 400 in accordance with the present invention having a raised outer peripheral mass 430, square in cross-section on a club head body 414 having a more traditional, less aerodynamic outer surface.

Figure 12:
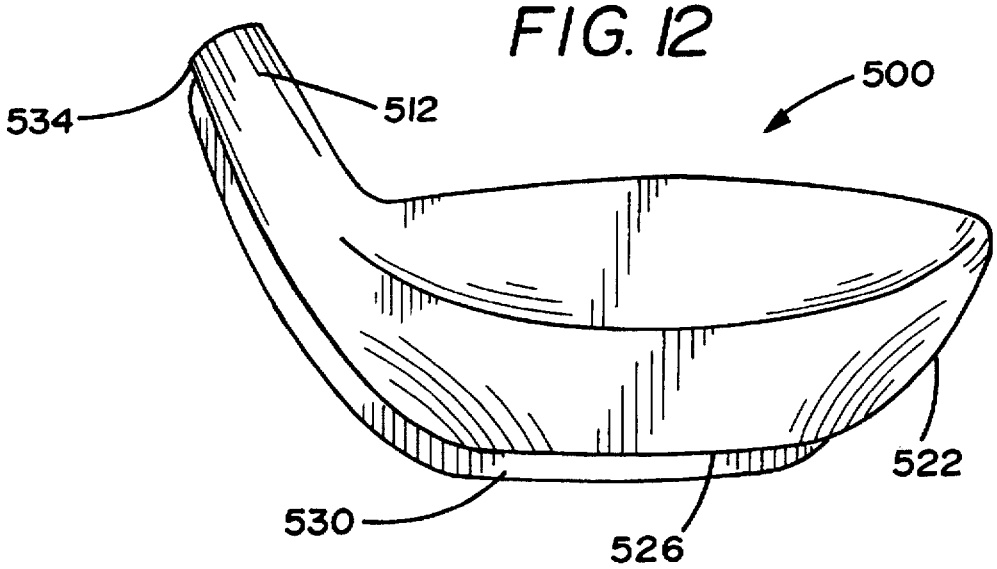
FIG. 12 is a rear elevational of view a sixth embodiment of the present invention.

FIG. 12 shows a sixth embodiment of a club head 500 having an elevated outer peripheral mass 530 which extends from a rear portion 534 of the hosel 512 downwardly along the bottom surface 526 and terminating before the toe surface 522.

FIG. 13 shows a seventh embodiment of a club head 600 in accordance with the present invention wherein an elevated outer peripheral mass 630 extends from a rear surface 634 of a hosel 612 downwardly past the heel surface 620, the bottom surface 626, and toe surface 622 terminating at the upper edge of the heel surface.

FIG. 14 shows an eighth embodiment of a club head 700 of the present invention having an elevated outer peripheral mass 730 which extends from a forward surface 732 of a hosel 712 downwardly across an upper surface 718 and toe surface 722.

FIG. 15 shows a ninth embodiment of a club head 800 in accordance with the present invention having an elevated outer peripheral mass 830 extending from a forward surface 832 of a hosel 812 across the top surface 818 and terminating thereon.

FIGS. 16 and 17 show a tenth embodiment of a club head 900 having an elevated outer peripheral mass 930 with a gap 935 formed approximately midway on the upper surface 918 of the club head 900.

FIG. 18 shows an eleventh embodiment of a club head 1000 in accordance with the present invention having an elevated outer peripheral mass 1030 with two gaps 1035, 1036 on the top surface 1018. Gap 1035 is located adjacent the hosel 1012, whereas a second gap 1036 is located adjacent the toe 1022.

FIG. 19 shows a twelfth embodiment of a golf club head 1100 having an elevated outer peripheral mass 1130 which begins part way down the hosel 1112 and includes a gap 1135 at the toe surface 1122.

FIGS. 20 and 21 show a thirteenth embodiment of a golf club head 1200 in accordance with the present invention. An elevated outer peripheral mass 1230 includes a gap 1235 located at the bottom surface 1226.

FIGS. 22 and 23 show a fourteenth embodiment of a golf club head 1300 in accordance with the present invention including an elevated outer peripheral mass 1330 having two gaps 1335, 1336 on the bottom surface 1326 adjacent the toe surface 1322 and heel surface 1320, respectively.

FIG. 24 shows a fifteenth embodiment of a club head 1400 having a thicker elevated outer peripheral mass 1430 which extends around the entire periphery of the club head except for the frontal surface 1432 of the hosel 1412.

FIGS. 25 and 26 show a sixteenth embodiment of a club head 1500 having a thicker elevated outer peripheral mass 1530 with a gap 1535 at a rearward surface 1534 of the hosel 1512.

Figure 27:
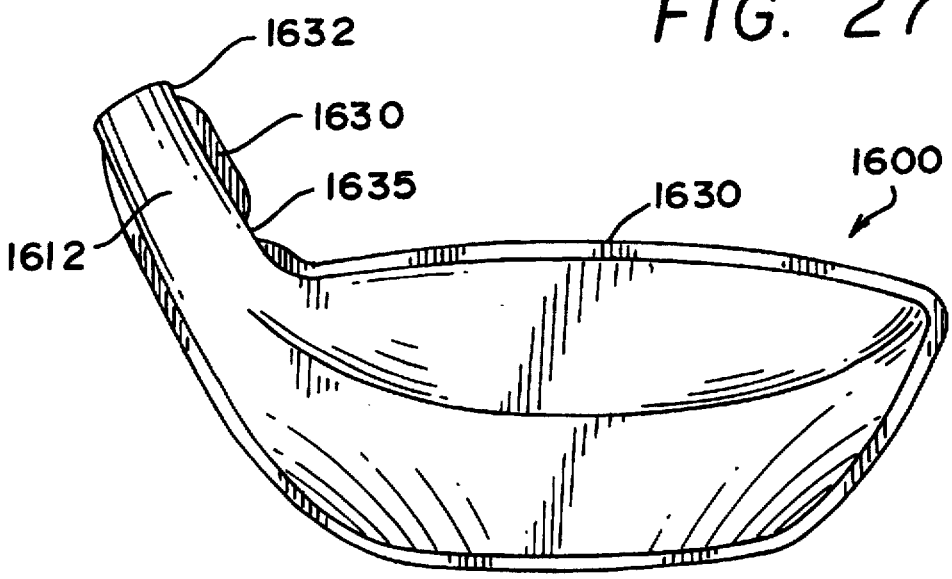
FIG. 27 is a rear elevational view of a seventeenth embodiment of the present invention.
Figure 28:
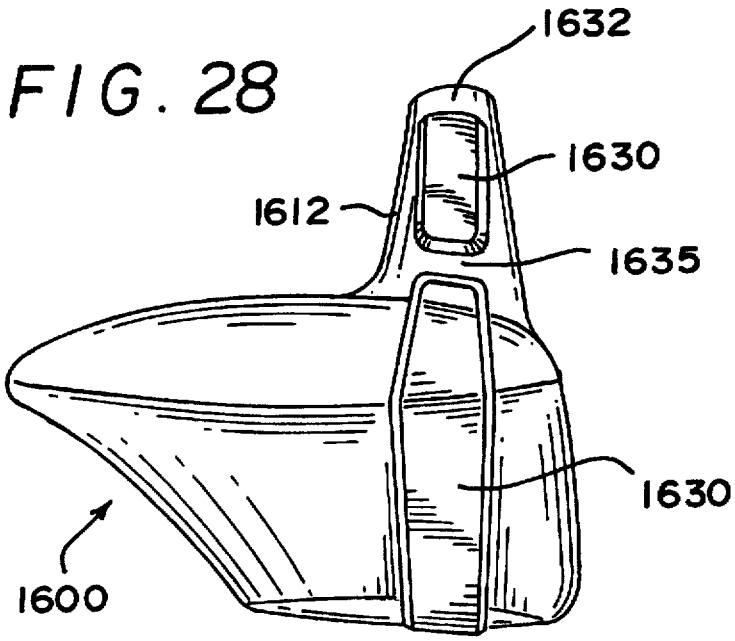
FIG. 28 is a toe elevational view of the club head of FIG. 27.

FIGS. 27 and 28 show a seventeenth embodiment of a club head 1600 having an elevated outer peripheral mass 1630 with a gap 1635 on the front surface 1632 of the hosel 1612.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. A metal wood type of golf club head having a hosel for attachment to a shaft and a club head body formed of a metal shell having an outer surface including a ball striking face, upper surface, bottom surface, rear surface, toe surface and heel surface, wherein the improvement comprises:

an elevated outer perimeter mass extending from a surface on said hosel onto and outwardly from at least a part of said outer surface of said metal shell of said club head body, connecting said hosel with said club head body.

2. The club head of claim 1, wherein said elevated outer perimeter mass extends in a heel to toe direction along said outer surface of said metal shell.

3. The club head of claim 2, wherein said elevated outer perimeter mass extends around and overlays the entire outer perimeter of said club head from a frontal surface of said hosel, across said top surface, toe surface, bottom surface and heel surface of said club head body to a rear surface of said hosel.

4. The club head of claim 2, wherein said elevated outer perimeter mass extends from a point part way along said hosel to said outer surface of said metal shell of said club head body.

5. The club head of claim 2, wherein said elevated outer perimeter mass extends from said hosel part way around the entire perimeter of said club head.

6. The club head of claim 5, wherein said elevated outer perimeter mass includes a gap along its length.

7. The club head of claim 6, wherein said gap is located on said upper surface.

8. The club head of claim 6, wherein said gap is located at said toe surface.

9. The club head of claim 6, wherein said gap is located at said bottom surface.

10. The club head of claim 6, wherein said gap is located on a rear surface of said hosel.

11. The club head of claim 6, wherein said gap is located on a front surface of said hosel.

12. The club head of claim 5, wherein said elevated outer perimeter mass includes a plurality of gaps along its length.

13. The club head of claim 12, wherein said plurality of gaps are located on said upper surface.

14. The club head of claim 13, wherein said plurality of gaps are two; a first gap located toward said hosel and a second located toward said toe surface.

15. The club head of claim 12, wherein said plurality of gaps are located on said bottom surface.

16. The club head of claim 15, wherein said plurality of gaps are two; a first located toward said heel surface and a second located toward said toe surface.

17. The club head of claim 5, wherein said elevated outer perimeter mass extends from a rear portion of said hosel and said heel surface and bottom surface of said club head body.

18. The club head of claim 5, wherein said elevated outer perimeter mass extends from a rear portion of said hosel, the heel surface, the bottom surface, and the toe surface of said club head body.

19. The club head of claim 5, wherein said elevated outer perimeter mass extends from a front surface of said hosel, the upper surface, and the toe surface of said club head body.

20. The club head of claim 5, wherein said elevated outer perimeter mass extends from a front surface of said hosel and the upper surface of said club head body.

* * * * *